US008292291B2

(12) United States Patent
Amamoto

(10) Patent No.: US 8,292,291 B2
(45) Date of Patent: Oct. 23, 2012

(54) IMAGE FORMING APPARATUS, RECORDING MEDIUM TRANSPORTATION APPARATUS, RECORDING MEDIUM TRANSPORTATION METHOD AND COMPUTER READABLE MEDIUM

(75) Inventor: Hidekazu Amamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 285 days.

(21) Appl. No.: 12/758,409

(22) Filed: Apr. 12, 2010

(65) Prior Publication Data

US 2011/0068535 A1 Mar. 24, 2011

(30) Foreign Application Priority Data

Sep. 24, 2009 (JP) ..... 2009-219075

(51) Int. Cl.
*B65H 43/00* (2006.01)

(52) U.S. Cl. ..... 271/176; 271/198; 271/314; 271/207

(58) Field of Classification Search ..... 271/176, 271/198, 199, 314, 207; 399/405; 221/239, 221/255

See application file for complete search history.

(56) References Cited

U.S. PATENT DOCUMENTS 6,289,261 B1 * 9/2001 Heidel et al. ..... 700/231
2009/0269115 A1 * 10/2009 Sato et al. ..... 399/405

FOREIGN PATENT DOCUMENTS

JP A-2004-352423 12/2004
JP A-2008-297091 12/2008
JP A-2008-304751 12/2008

* cited by examiner

*Primary Examiner* — David H Bollinger
(74) *Attorney, Agent, or Firm* — Oliff & Berridge, PLC

(57) ABSTRACT

An image forming apparatus includes: an image forming unit forming an image on a recording medium; a first transportation route that forms a transportation route for the recording medium extending to an outside of the apparatus, and that has a transportation route length longer than a maximum length in a transportation direction of the recording medium, the transportation route length being from an image formation functional unit at a most downstream portion of the image forming unit in the transportation direction to an output position of the recording medium; and a recording medium transportation unit that, upon output of a part of the recording medium from the first transportation route, stops the transportation in a state of holding a remaining part of the recording medium in the first transportation route, and outputs the recording medium to the outside in accordance with pull out operation for the stopped recording medium.

11 Claims, 13 Drawing Sheets

IMAGE FORMING APPARATUS, RECORDING MEDIUM TRANSPORTATION APPARATUS, RECORDING MEDIUM TRANSPORTATION METHOD AND COMPUTER READABLE MEDIUM

CROSS REFERENCE TO RELATED APPLICATIONS

This application is based on and claims priority under 35 USC §119 from Japanese Patent Application No. 2009-219075 filed Sep. 24, 2009.

BACKGROUND

1. Technical Field

The present invention relates to an image forming apparatus, a recording medium transportation apparatus, a recording medium transportation method and a computer readable medium storing a program.

2. Related Art

In general, in image forming apparatuses such as copy machines, printers and the like, a recording medium on which image forming processing has been performed is immediately outputted to an outside of the apparatus, and is supplied to a user.

SUMMARY

According to an aspect of the present invention, there is provided an image forming apparatus including: an image forming unit that forms an image on a recording medium; a first transportation route that forms a transportation route for the recording medium received from the image forming unit, the transportation route extending to an outside of the image forming apparatus, and that has a transportation route length for the recording medium longer than a maximum length in a transportation direction of the recording medium usable in the image forming unit, the transportation route length being from a position of an image formation functional unit arranged at a most downstream portion of the image forming unit in the transportation direction of the recording medium to a position where the recording medium is outputted to the outside of the image forming apparatus; and a recording medium transportation unit that, upon output of a part of the recording medium from the first transportation route through the transportation of the recording medium along the first transportation route, stops the transportation of the recording medium in a state where a remaining part of the recording medium is held in the first transportation route, and outputs the recording medium to the outside of the image forming apparatus in accordance with pull out operation by a user for the recording medium whose transportation has been stopped.

BRIEF DESCRIPTION OF THE DRAWINGS

Exemplary embodiments of the present invention will be described in detail based on the following figures, wherein:

FIGS. 10-1, 10-2 and 10-3 are flowcharts showing an example of the contents of the sheet transportation control for the sheet transportation mechanism, performed by the main controller.

DETAILED DESCRIPTION

Hereinafter, exemplary embodiments of the present invention will be described in detail with reference to the attached drawings.

First Exemplary Embodiment

Description of Entire Configuration of Image Forming Apparatus

Figure 1:
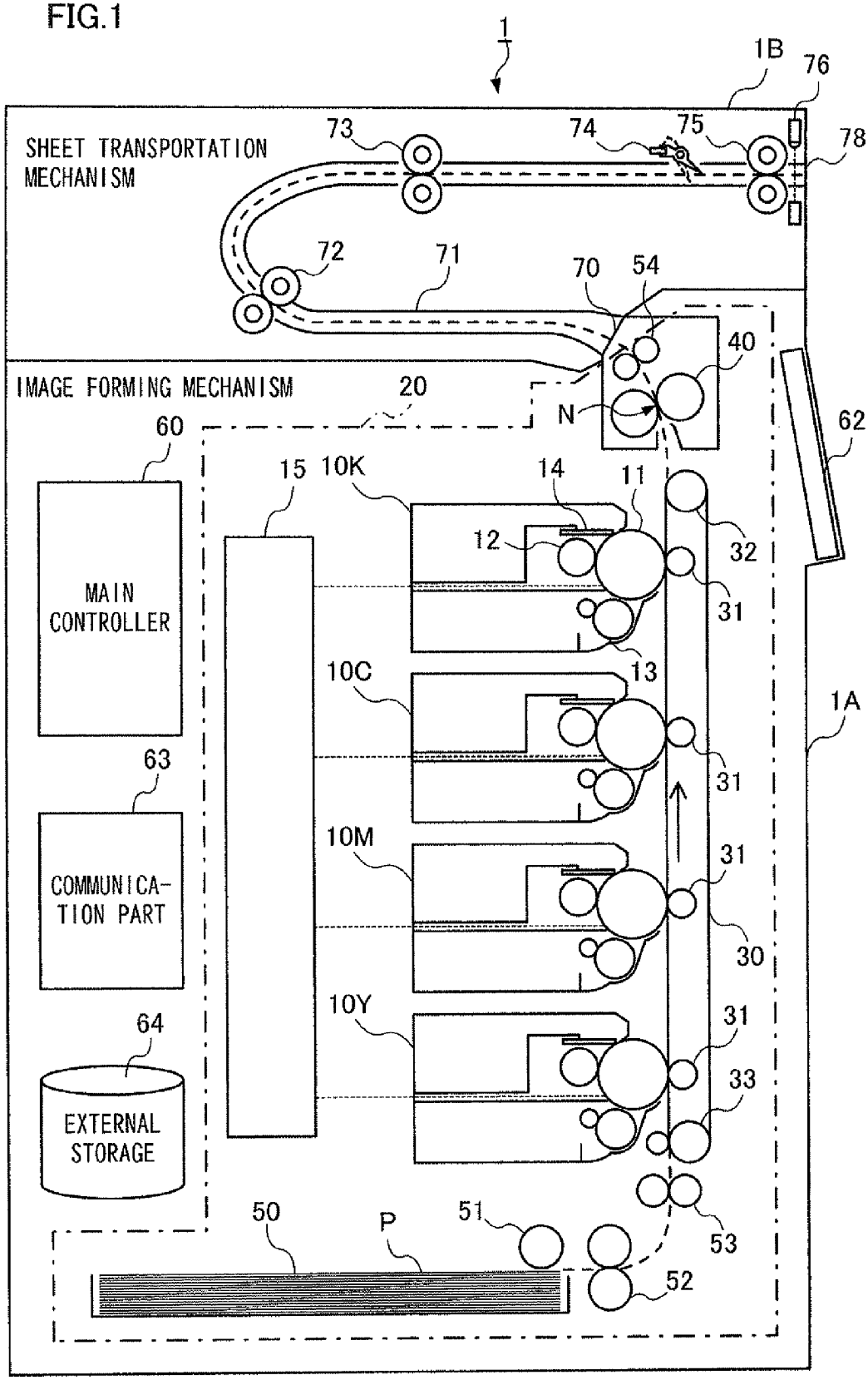
FIG. 1 shows a configuration of an image forming apparatus to which the first exemplary embodiment is applied.

FIG. 1 shows a configuration of an image forming apparatus 1 to which the first exemplary embodiment is applied. The image forming apparatus 1 shown in FIG. 1 is a color printer employing an electrophotographic method, and includes an image forming mechanism 1A that forms a color image on a recording medium (sheet) P on the basis of image data, and a sheet transportation mechanism 1B that transports the sheet P on which the color image has been formed in the image forming mechanism 1A to the outside.

The image forming apparatus 1 according to the first exemplary embodiment is different from one installed in a place such as a general office or the like where users are limited to a specific kind of people. It is assumed that the image forming apparatus 1 is installed, for example, at an aisle or along a wall in a public facility such as a station, an airport or the like where a large number of unspecified users access. Thus, the image forming apparatus 1 according to the first exemplary embodiment employs a mechanism for reducing an occurrence of trouble such as an occurrence of breakdown caused by a user action, an occurrence that the sheet P on which the various kinds of information has been formed as an image is left as garbage, or the like, as will be described below.

<Description of Configuration of Image Forming Mechanism>

The image forming mechanism 1A includes an image forming part 20, serving as an example of an image forming unit, which forms a color image on a sheet P, a main controller 60, serving as an example of a controller, which performs operation control of the entire image forming apparatus 1 (the image forming mechanism 1A and the sheet transportation mechanism 1B) and information processing such as image processing and the like, and an operation display panel 62 that is arranged on, for example, a front side of the image forming apparatus 1 (a side located on the right side of FIG. 1), that receives an operation input by a user and that displays various kinds of information for the user. Further, the image forming mechanism 1A includes a communication part 63 that is connected to, for example, a database (not shown in the figure) or the like installed in the outside, through a communication line, and that sends and receives information to and from the database or the like, and an external storage 64 in which processing programs and various kinds of information such as image information and the like are stored.

The image forming part 20 of the image forming mechanism 1A includes four image formation units 10Y, 10M, 10C and 10K (hereinafter, referred to as "image formation units 10"), each serving as an image formation functional unit, which form a yellow (Y) toner image, a magenta (M) toner image, a cyan (C) toner image, and a black (K) toner image, respectively. These image formation units 10 are arranged in parallel at certain intervals in an up-and-down direction (approximately the vertical direction), and each include a photoconductive drum 11 as an image carrier, a charging device 12 that charges a surface of the photoconductive drum 11, a developing device 13 that develops an electrostatic latent image formed on the photoconductive drum 11 with each color toner, and a cleaning unit 14 that cleans the surface of the photoconductive drum 11 after the transfer.

Further, the image forming part 20 includes a laser exposure device 15, serving as an example of the image formation functional unit, which exposes the photoconductive drums 11 serving as an example of the image formation functional unit and arranged in the respective image formation units 10, on the basis of the respective color image datasets, and a sheet transportation belt 30 that transports a sheet P while being in contact with the photoconductive drums 11 of the image formation units 10. The sheet transportation belt 30 is formed by a film-shaped endless belt that electrostatically attracts a sheet P. In addition, the sheet transportation belt 30 is stretched and held by a drive roll 32 and an idle roll 33 and cyclically moves. Further, the sheet transportation belt 30 transports the sheet P between the sheet transportation belt 30 and the photoconductive drums 11 from the lower side toward the upper side in approximately the vertical direction (arrow direction in FIG. 1).

Furthermore, the image forming part 20 includes transfer rolls 31, serving as an example of the image formation functional unit, which are located inside the sheet transportation belt 30 and at positions facing the corresponding photoconductive drums 11. The transfer rolls 31 sequentially transfer the respective color toner images formed in the image formation units 10, on the sheet P to be transported while being held by the sheet transportation belt 30.

Still furthermore, the image forming part 20 includes a fixing device 40, serving as an example of a fixing part (image formation functional unit), and a sheet output roll 54 that sends the sheet P subjected to the fixing processing in the fixing device 40 to the sheet transportation mechanism 1B. Here, the fixing device 40 and the sheet output roll 54 are located on the downstream side of the sheet transportation belt 30 in the sheet transportation direction. The fixing device 40 forms a nip portion N where, for example, a belt member and a roll member forming a pair are pressed against each other. Here, the belt member and the roll member apply heat and pressure on an unfixed toner image on the sheet P. This nip portion N forms a position at which the fixing processing is performed. In the fixing device 40, the unfixed toner image is fixed on the sheet P by causing the sheet P holding the unfixed toner image to pass through the nip portion N. The sheet P subjected to the fixing processing is sent to the sheet transportation mechanism 1B by the sheet output roll 54.

Still furthermore, the image forming part 20 includes a sheet container 50 that contains sheets P, a pick-up roll 51 that feeds the sheet P contained in this sheet container 50, a transportation roll 52 that transports the sheet P fed by the pick-up roll 51, and a resist roll 53 that sends the sheet P to the sheet transportation belt 30 in accordance with the image forming operation. Here, the sheet container 50, the pick-up roll 51, the transportation roll 52 and the resist roll 53 are located on the upstream side of the sheet transportation belt 30 in the sheet transportation direction.

Note that, structural parts and functional parts related to the image forming processing located between the sheet container 50 and the fixing device 40, such as the image formation units 10, the laser exposure device 15, the sheet transportation belt 30, the transfer rolls 31 and the like, function as a toner image forming part.

<Description of Operation of Image Forming Mechanism>

When the image forming mechanism 1A according to the first exemplary embodiment receives an operation input by a user through the operation display panel 62, the main controller 60 analyses contents of the instruction inputted by the user. Then, the main controller 60 transmits a transmission request on information corresponding to the contents of the instruction by the user to, for example, the database (not shown in the figure) installed in the outside, through the communication part 63. Upon receiving, from the database to the communication part 63, the information for which the transmission request has been made, the main controller 60 performs processing such as image processing or the like for the received information, and generates respective color image datasets. Then, the main controller 60 outputs the respective color image datasets thus generated, to the laser exposure device 15. By this operation, the laser exposure device 15 exposes the photoconductive drums 11 of the image formation units 10 on the basis of the respective color image datasets, and thereby respective color toner images of Y, M, C and K are formed in the image formation units 10.

When the respective color toner images are started to be formed in the image formation units 10, a sheet P is picked up from the sheet container 50. Then, the sheet P is transported to the resist roll 53 by the transportation roll 52, and is supplied to the sheet transportation belt 30 by the resist roll 53 in accordance with the timing when the toner images are formed. The sheet transportation belt 30 holds and transports the sheet P. During this operation, the respective color toner images are sequentially transferred onto the sheet P, by using transfer electric fields formed by the transfer rolls 31.

The sheet P on which the color toner images have been electrostatically transferred is separated from the sheet transportation belt 30 at a downstream position of the image formation unit 10K, and is transported to the fixing device 40. When the sheet P is transported to the fixing device 40, the unfixed toner image on the sheet P is fixed on the sheet P by causing the sheet P to pass through the nip portion N where the belt member and the roll member forming a pair are pressed against each other. Thereafter, the sheet P on which the color toner images have been fixed is sent to the sheet transportation mechanism 1B from the sheet output roll 54.

<Description of Configuration of Sheet Transportation Mechanism>

The sheet transportation mechanism 1B includes a first transportation route 71 that receives the sheet P sent from the sheet output roll 54 of the image forming mechanism 1A at a receiving port 70 and that guides the sheet P to an output port 78 arranged on the front side of the image forming apparatus 1 (the side located on the right side of FIG. 1). Further, the sheet transportation mechanism 1B includes transportation rolls 72 and 73, serving as an example of a recording medium transportation unit, which transport the sheet P in the first transportation route 71, a first sheet passage detection part 74, serving as an example of a detection unit (first detection unit), which detects the passage of the sheet P and is arranged at a predetermined position on the first transportation route 71, a discharge roll 75 that discharges the sheet P transported by the transportation rolls 72 and 73 from the output port 78, and a sheet output detection part 76 that detects that the sheet P is outputted from the output port 78.

The first sheet passage detection part 74 is configured of an actuator swinging by a contact with the sheet P and a light detection part that detects the swing of the actuator through shielding or transmission of light by a light shielded part provided in the actuator. By this configuration, the first sheet passage detection part 74 detects that the top end S and the back end T of the sheet P pass therethrough, through a change from the transmission of the light to the shielding of the light and a change from the shielding of the light to the transmission of the light, by use of the light detection part. The first sheet passage detection part 74 is arranged on a downstream side of the transportation rolls 73 in the sheet transportation direction on the first transportation route 71, and on an upstream side of the discharge roll 75 arranged in vicinity of the output port 78 that is the terminal end of the first transportation route 71.

The sheet output detection part 76 detects that the sheet P is outputted from the output port 78 by receiving a light emitted from a light emission part by a light receiving part. Here, the light emission part and the light receiving part are arranged in the up-and-down direction while the first transportation route 71 is interposed therebetween. The sheet output detection part 76 is arranged on a downstream side of the discharge roll 75 in the sheet transportation direction and an upstream side of the output port 78.

<Description of Operation of Sheet Transportation Mechanism>

When receiving the sheet P on which the various kinds of information has been formed as an image in the image forming mechanism 1A, the sheet transportation mechanism 1B according to the first exemplary embodiment transports the sheet P toward the output port 78 configuring a position where the sheet P is outputted to the outside (outside of the image forming apparatus 1), by use of the transportation rolls 72 and 73 and the discharge roll 75. Then, when the sheet P arrives at a position where the top end S thereof is discharged from the output port 78 by a predetermined length, the transportation rolls 72 and 73 and the discharge roll 75 are stopped in a state where a part of the sheet P is held in the first transportation route 71, and the sheet transportation operation is finished.

Here, driving force from a drive motor (not shown in the figure) is transmitted to the transportation rolls 72 and 73 and the discharge roll 75 arranged in the sheet transportation mechanism 1B. On the other hand, transmission of force from the transportation rolls 72 and 73 and the discharge roll 75 to the drive motor is configured so as to be in a low load condition. By this configuration, in a case where the transportation rolls 72 and 73 and the discharge roll 75 are stopped in a state where the part of the sheet P is held in the first transportation route 71, the transportation rolls 72 and 73 and the discharge roll 75 rotate with a low load in accordance with the movement of the sheet P caused by pull out operation by a user for the portion of the sheet P discharged from the first transportation route 71 (output port 78). By this operation, the sheet P held in the first transportation route 71 may be pulled out from the first transportation route 71 in the sheet transportation mechanism 1B. Then, the sheet P on which the various kinds of information has been formed as an image is to be provided to the user by the pull out operation for the sheet P by the user. Outputting the sheet P from the output port 78 is detected by the sheet output detection part 76. The transportation rolls 72 and 73 and the discharge roll 75 may be activated upon the detection of the pull out operation for the sheet P by the user.

<Description of Stop of Sheet Transportation Operation in Sheet Transportation Mechanism>

It is assumed that the image forming apparatus 1 according to the first exemplary embodiment is used by unspecified users, as mentioned above. For this assumption, in order that the user may more securely receive a sheet P on which the various kinds of information has been formed as an image, the sheet transportation mechanism 1B has a configuration in which a user ready to receive the sheet P outputs the sheet P, instead of the configuration in which the sheet P is immediately outputted to the outside thereof. By this configuration, the sheet transportation mechanism 1B stops the sheet P at a position where the top end S of the sheet P is discharged from the output port 78 of the sheet transportation mechanism 1B by the predetermined length. Then, the sheet transportation mechanism 1B is configured so that the user performs the pull out operation for the sheet P in the state where a part of the sheet P on the top end S side is outputted from the output port 78, and thereby the entire sheet P is outputted to the outside thereof. By this configuration, for example, in a case where the user's hands are full of bags or the like and the user is unable to immediately receive the sheet P, the sheet P on which the image formation has been performed is kept in a holding state in the sheet transportation mechanism 1B, and a standby state is set and continued until the user receives the sheet P. Accordingly, an occurrence that a sheet P is dropped onto, for example, a floor and the sheet P ends up in the garbage or the like is reduced.

In the image forming apparatus 1 according to the first exemplary embodiment, at the time of stopping the sheet P in the sheet transporting mechanism 1B, the main controller 60 of the image forming mechanism 1A measures time from a time point when the top end S of the sheet P passes through the first sheet passage detection part 74. Then, from the measured time and the sheet transportation speed of the transporting rolls 72 and 73 and the discharge roll 75, the moving amount of the sheet P is calculated. Then, the main controller 60 recognizes the time point when the top end S of the sheet P is discharged from the output port 78 by the predetermined length on the basis of the calculated moving amount of the sheet P, and at this time point, the main controller 60 stops the driving of the transportation rolls 72 and 73 and the discharge roll 75.

Note that, as "the predetermined length from the output port 78 (a part of the sheet P on the top end S side)," the length of the sheet P easily to be taken by a user is set, for example. For example, the length of approximately 5 cm to 15 cm from the output port 78 (the length in the sheet P) is set.

However, as long as the user is able to take out the sheet P, any length may be set as "the predetermined length from the output port 78." For example, the length which satisfies a condition that the top end S of the sheet P is located on the outside of a line connecting the upper outer wall and the lower outer wall of the output port 78 may be set. Alternatively, if the output port 78 has enough width to put fingers of a user, the length which satisfies a condition that the top end S of the sheet P is located on the outside of a tangent line on the output port 78 side which are shared by the upper roll (see the "upper roll 90" in FIGS. 2 and 3A to be described later) and the lower roll (see the "lower roll 100" in FIGS. 2 and 3A to be described later) configuring the discharge roll 75 may be set. In this case, "the predetermined length from the output port 78" may be set to have a minus value (to be located in an anterior direction from the output port 78 in the first transportation route 71) if the position of the output port 78 is set as a reference.

<Description of Configuration in which Sheet is Pulled Out by User>

Next, a description will be given of a configuration of the sheet transportation mechanism 1B in which the sheet P stopped in the first transportation route 71 is pulled out by a user.

Figure 2:
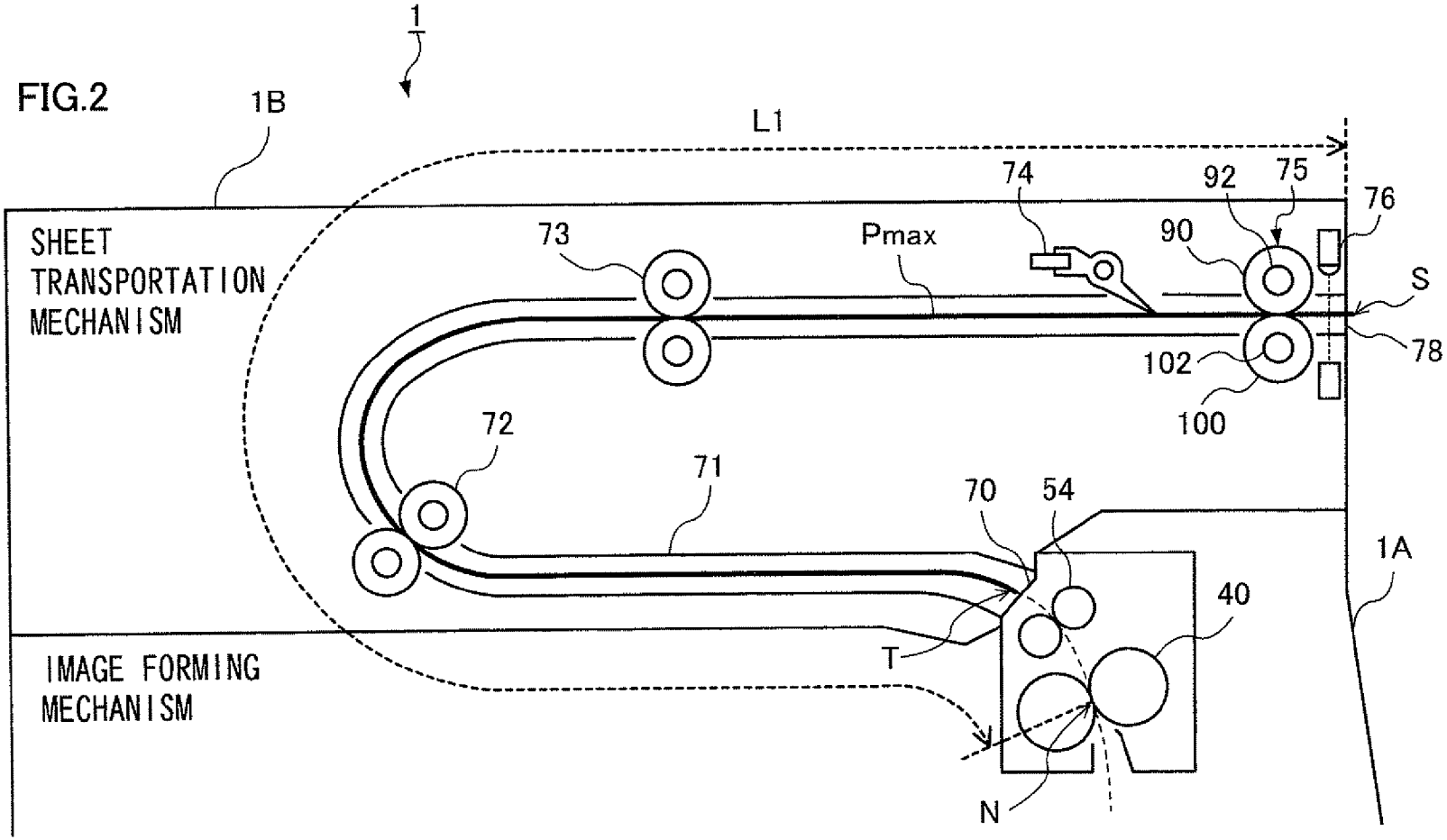
FIG. 2 is a view showing a configuration of the sheet transportation mechanism according to the first exemplary embodiment.

FIG. 2 is a view showing a configuration of the sheet transportation mechanism 1B according to the first exemplary embodiment. As shown in FIG. 2, the sheet transportation mechanism 1B according to the first exemplary embodiment has transportation route length L1 longer than the maximum length in the transportation direction of the sheet Pmax (for example, the length of the A3 size) usable in the image forming mechanism 1A. Here, the transportation route length L1 is from a position of a nip portion N of the fixing device 40 of the image forming mechanism 1A (image formation functional unit arranged at the most downstream portion of the image forming unit in the transportation direction of the recording medium) to the position of the output port 78 as a terminal end of the first transportation route 71. By this configuration, at the time point when the top end S of the sheet Pmax having the maximum length in the transportation direction among sheets usable in the image forming mechanism 1A arrives at the output port 78, the back end T of the sheet Pmax is put at a position so as to be outputted from the nip portion N of the fixing device 40.

Thus, even if the user immediately performs the pull out operation for the sheet P at the time point when the top end S of the sheet P is outputted from the output port 78, the fixing processing in the fixing device 40 has been completed on the entire sheet P regardless of the size of the sheet P usable in the image forming mechanism 1A. Accordingly, damage of the belt member forming the nip portion N of the fixing device 40, meandering of the belt members is suppressed even if the fixing device 40 receives, through the sheet P, the pull out force by the pull out operation by a user. In addition, strain on the toner image on the sheet P at the nip portion N and strain of the belt member caused by the strain on the sheet P, and transfer of the strain on the subsequently transported sheet P are also suppressed.

Figure 3A:
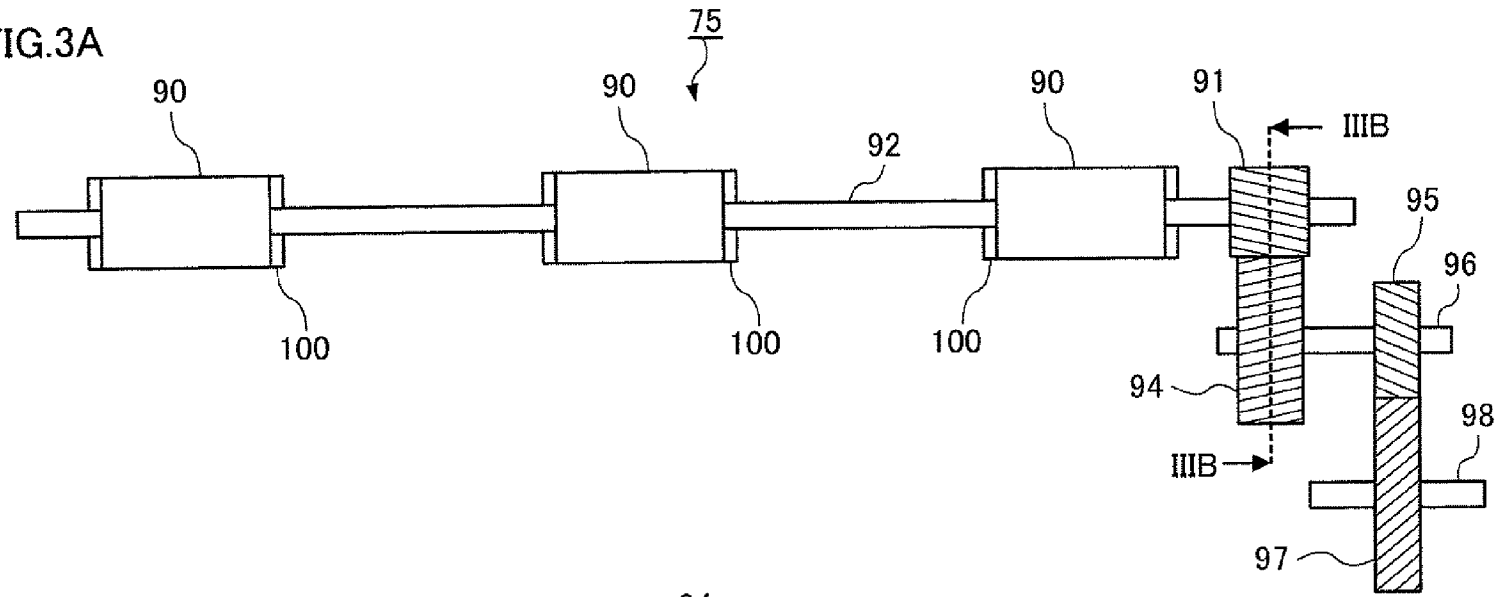
FIGS. 3A and 3B are views for explaining the configurations of the transportation rolls and the discharge roll.
Figure 3B:
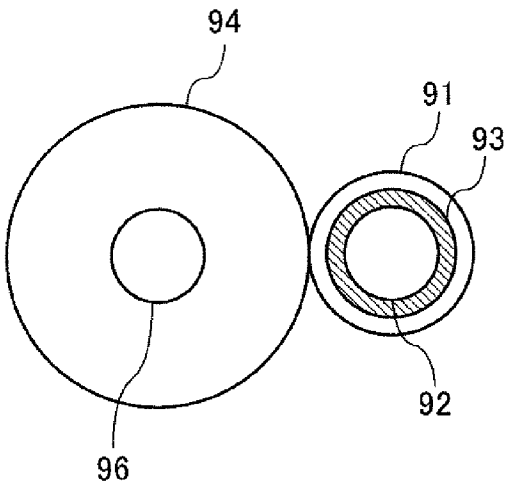

Next, FIGS. 3A and 3B are views for explaining the configurations of the transportation rolls 72 and 73 and the discharge roll 75, which are rotatable in accordance with the movement of the sheet P pulled out by a user. FIG. 3A is a plan view of the entire configuration of the discharge roll 75, as an example, and FIG. 3B is a cross-sectional view of FIG. 3A taken along a line IIIB-IIIB.

First, as shown in FIG. 3A, the discharge roll 75 is formed of the upper rolls 90 and the lower rolls 100. The upper rolls 90 and the lower rolls 100 discharge a sheet P toward the output port 78, and the upper rolls 90 and the lower rolls 100, which form plural pairs, are fixed along the directions of the lengths of rotation axes 92 and 102, respectively (also see FIG. 2, and the rotation axis 102 is not shown in FIG. 3A since the rotation axis 102 is hidden by the rotation axis 92). Both of these rotation axes 92 and 102 are rotatably supported by the housing of the main body of the sheet transportation mechanism 1B.

On one end side of the rotation axis 92, a drive transmission gear 91 is fixed. The drive transmission gear 91 is connected to a gear 94 fixed to a rotation axis 96 arranged in parallel to the rotation axis 92, so as to be engaged with the gear 94. To the rotation axis 96, a gear 95 is also fixed. The gear 95 is connected to a gear 97 fixed to a rotation axis 98 to which the rotation drive force is transmitted from the drive motor (not shown in the figure), so as to be engaged with the gear 97. Therefore, in the discharge roll 75, the rotation drive force from the drive motor is transmitted by using a route from the rotation axis 98 to the upper rolls 90 via the gear 97, the gear 95, the rotation axis 96, the gear 94, the drive transmission gear 91, and the rotation axis 92. In this configuration, the drive force is not directly applied on the lower rolls 100, and thus the lower rolls 100 are driven by the upper rolls 90 to rotate.

As mentioned above, in the discharge roll 75, in a case where the drive motor drives, the rotation drive force of the drive motor rotates the upper rolls 90, and the sheet P is transported toward the output port 78 by the upper rolls 90 driven to be rotated and the lower rolls 100 driven by the upper rolls 90.

As shown in FIG. 3B, a one-way clutch 93 is arranged between the drive transmission gear 91 and the rotation axis 92. Here, the one-way clutch 93 is coaxial with the rotation axis 92. The one-way clutch 93 transmits, to the rotation axis 92, the rotation torque received by the drive transmission gear 91 from the gear 94. On the other hand, the one-way clutch 93 does not transmit the rotation torque from the rotation axis 92 in the same rotational direction to the drive transmission gear 91. Thereby, even if the driving of the drive motor is stopped and the high rotation torque is applied on the drive transmission gear 91 due to the connection and engagement between the drive transmission gear 91 and the gear 94, the rotation axis 92 (specifically, the upper rolls 90 and the lower rolls 100) rotates in a low load condition by an effect of the one-way clutch 93 in a case where the user intends to pull out the sheet P. The principal configurations of the transportation rolls 72 and 73 are the same as the discharge roll 75 shown in FIGS. 3A and 313.

Thus, the user may pull out the sheet P with relatively small force.

As mentioned above, in the image forming apparatus 1 according to the first exemplary embodiment, the transportation route length L1 of the first transportation route 71 from the position of the nip portion N of the fixing device 40 of the image forming mechanism 1A to the position of the output port 78 as the terminal end of the first transportation route 71 is configured to be the length longer than the maximum length in the transportation direction of the sheet Pmax usable in the image forming mechanism 1A. By this configuration, at the time point when the top end S of the sheet Pmax usable in the image forming mechanism 1A and having the maximum length in the transportation direction arrives at the output port 78, the fixing processing for the entire sheet P in the fixing device 40 has been completed.

Thus, even if a user forcedly performs pull out operation at the time point before the sheet P arrives at an assumed position for starting the pull out operation for the sheet P by a user, for example, just at the time point when the top end S of the sheet P is outputted from the output port 78, occurrences of troubles such as damages of the belt members and the like forming the nip portion N of the fixing device 40, strains on the sheet P and the like are reduced.

In the first exemplary embodiment, in a case where the sheet transportation mechanism 1B receives the sheet P on which the various kinds of information has been formed as an image in the image forming mechanism 1A, the sheet transportation mechanism 1B immediately transports the sheet P so that the top end S of the sheet P is discharged from the output port 78 of the sheet transportation mechanism 1B by the predetermined length, and then stops the sheet P.

Figure 4:
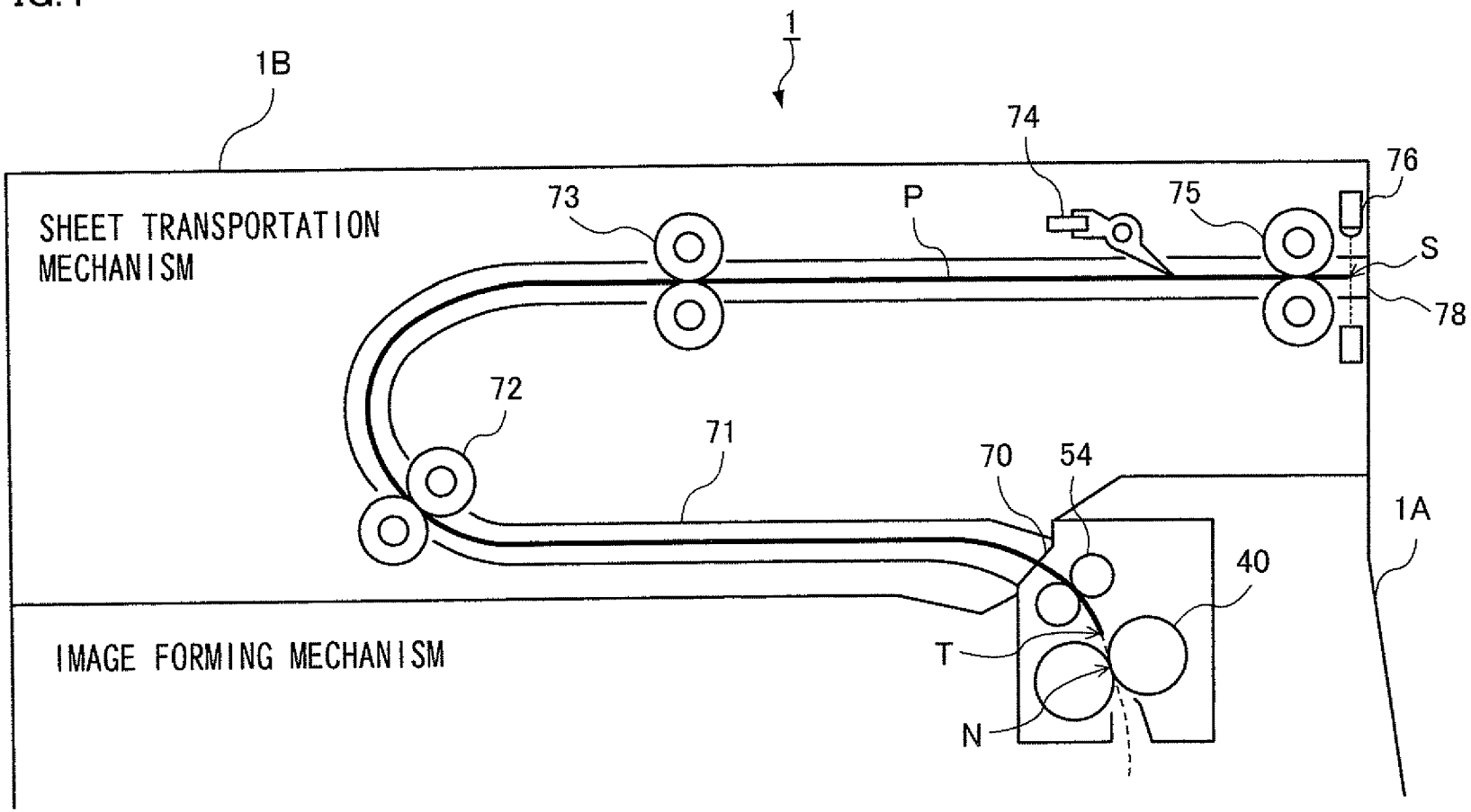
FIG. 4 is a view showing a state where the top end of the sheet is transported to a position just before the output port of the sheet transportation mechanism, and stops the sheet once.

Alternatively, as shown in FIG. 4 (a view showing a state where the top end S of the sheet P is transported to a position just before the output port 78 of the sheet transportation mechanism 1B, and stops the sheet P once), the following configuration is acceptable. Specifically, in a case where the sheet transportation mechanism 1B receives the sheet P on which the various kinds of information has been formed as an image in the image forming mechanism 1A, the sheet transportation mechanism 1B transports the sheet P so that the top end S of the sheet P is positioned at a position just before the output port 78 of the sheet transportation mechanism 1B, and stops (interrupts transportation of) the sheet P once. For example, in a case of receiving a sheet receiving request from a user through the operation display panel 62, the driving of the transportation rolls 72 and 73 and the discharge roll 75 is restarted in the sheet transportation mechanism 1B, and the sheet P may be stopped at a position so that the top end S of the sheet P is outputted from the output port 78 of the sheet transportation mechanism 1B by the predetermined length.

Thereby, forcible pull out operation by a user before the sheet P arrives at an assumed position for starting the pull out operation for the sheet P by a user is suppressed. Accordingly, an occurrence of damages of the transportation rolls 72 and 73 and the discharge roll 75 during the transportation of the sheet P and decrease in the transportation force to the sheet P due to the attachment of the paper dust on the surfaces of the respective rolls caused by friction with the sheet P are reduced. In addition, since the sheet P is discharged so that the sheet P is outputted from the output port 78 by the predetermined length immediately after the reception of sheet receiving request from a user, the user psychologically feels as if the time until the user receives the sheet P were shorter than the actual.

In this configuration, as the position where the sheet P is stopped once in the sheet transportation mechanism 1B, a position that satisfies any one of conditions that the top end S of the sheet P is located between the output port 78 and the discharge roll 75, and that the top end S of the sheet P is located on the upstream side of the discharge roll 75 in the sheet transportation direction may be set.

Second Exemplary Embodiment

In the first exemplary embodiment, the description has been given of a configuration in which the one output port 78 is formed on the one side of the image forming apparatus 1. In the second exemplary embodiment, a description will be given of a configuration in which respective output ports are formed on two sides facing each other in the image forming apparatus 1. Note that, the same reference numerals are used for the same configuration as those in the first exemplary embodiment, and the detailed description thereof will be omitted.

<Description of Configuration of Sheet Transportation Mechanism>

Figure 5:
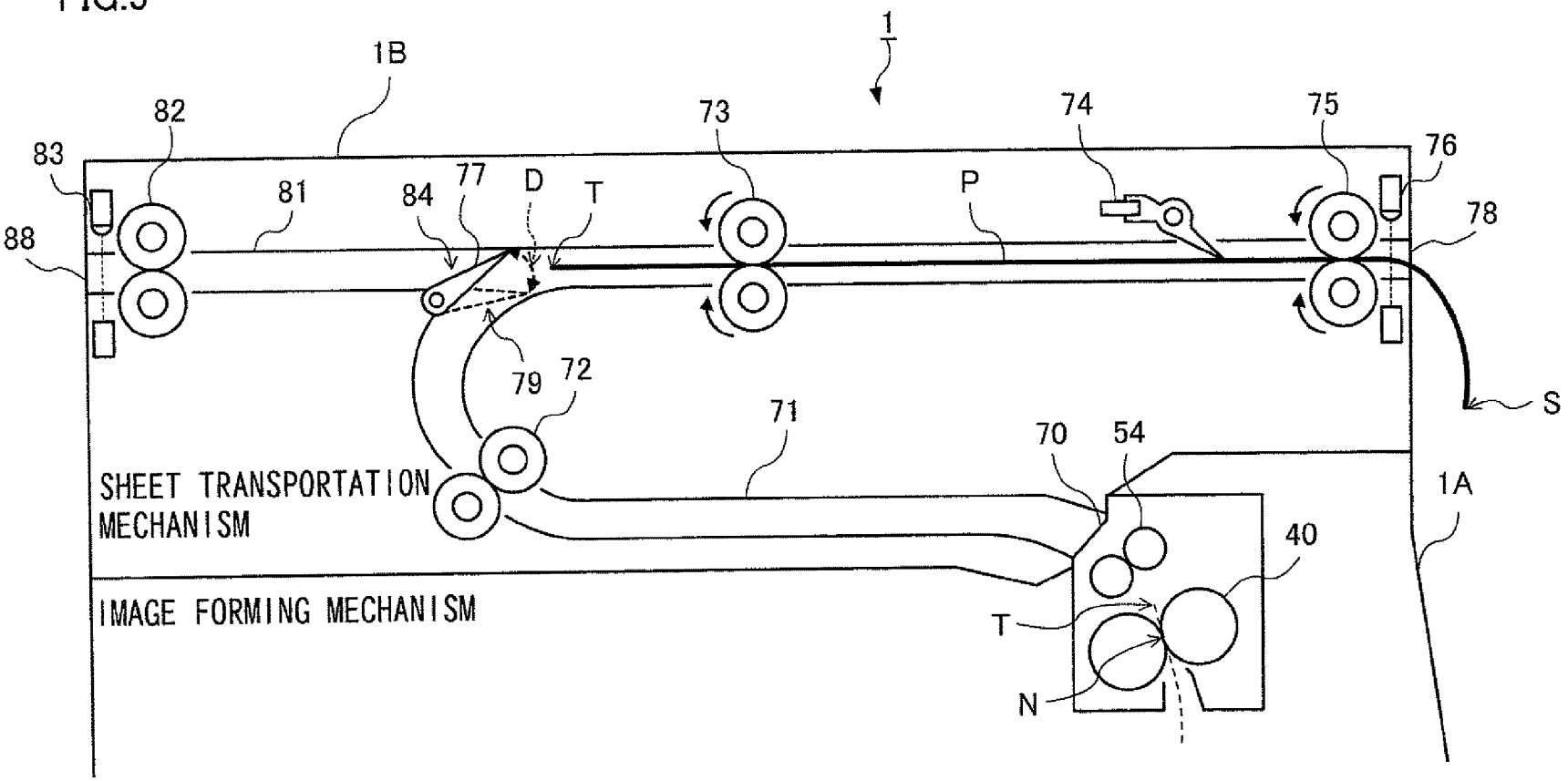
FIG. 5 is a view showing a configuration of the sheet transportation mechanism arranged in the image forming apparatus according to the second exemplary embodiment.

FIG. 5 is a view showing a configuration of the sheet transportation mechanism 1B arranged in the image forming apparatus 1 according to the second exemplary embodiment. As shown in FIG. 5, the sheet transportation mechanism 1B according to the second exemplary embodiment includes, in addition to the above-mentioned configuration shown in the first exemplary embodiment, a second transportation route 81 and a flapper 77. Here, the second transportation route 81 guides the sheet P held in the first transportation route 71 to an output port 88 arranged on the back side of the image forming apparatus 1 (a side located on the left side in FIG. 5). The flapper 77 is located on a bifurcation into the second transportation route 81 and the first transportation route 71, and guides the sheet P held in the first transportation route 71 toward the second transportation route 81.

The flapper 77 is set at the bifurcation into the first transportation route 71 and the second transportation route 81 in a tilted position toward a second transportation route side opening 84 (position shown with solid lines in FIG. 5), in a case where the sheet P is transported from the receiving port 70 to the output port 78 in the first transportation route 71. By this setting, at the bifurcation, a first transportation route side opening 79 is opened, while the second transportation route side opening 84 is closed. Meanwhile, the flapper 77 is set at the bifurcation in a tilted position toward the first transportation route side opening 79 (position shown with broken lines in FIG. 5), in a case where the sheet P is transported from the first transportation route 71 toward the output port 88 forming a position for outputting the sheet P to the outside (outside of the image forming apparatus 1) in the opposite direction in the second transportation route 81. By this setting, at the bifurcation, the first transportation route side opening 79 is closed, while the second transportation route side opening 84 is opened.

Further, the sheet transportation mechanism 1B includes a discharge roll 82 that discharges the sheet P sent from the first transportation route 71 from the output port 88 in the second transportation route 81, and a sheet output detection part 83 that detects that the sheet P is outputted from the output port 88.

<Description of Operation of Sheet Transportation Mechanism>

When receiving the sheet P on which the various kinds of information has been formed as an image in the image forming mechanism 1A, the sheet transportation mechanism 1B according to the second exemplary embodiment transports the sheet P toward the output port 78 by the transportation rolls 72 and 73 and the discharge roll 75, similarly to the case of the above-mentioned first exemplary embodiment. In this case, the flapper 77 is set at the bifurcation into the first transportation route 71 and the second transportation route 81 in the tilted position toward the second transportation route side opening 84 (position shown with the solid lines in FIG. 5). When the sheet P arrives at the position so that the top end S thereof is outputted from the output port 78 by the predetermined length, the transportation rolls 72 and 73 and the discharge roll 75 are stopped while a part of the sheet P is held in the first transportation route 71, and the sheet transportation operation is finished. Then, the sheet transportation mechanism 1B waits the pull out operation by a user for the part of the sheet P outputted from the first transportation route 71 (output port 78).

In the image forming apparatus 1 used by unspecific users, the following case may occur. Specifically, a user may not pull out the sheet P in the state where the part of the sheet P is held in the first transportation route 71 and the top end S thereof is outputted from the output port 78 by the predetermined length. Therefore, the sheet transportation mechanism 1B outputs the sheet P held in the first transportation route 71 from the output port 88 arranged on the back side of the image forming apparatus 1, after a predetermined period has passed since the transportation rolls 72 and 73 and the discharge roll 75 are stopped.

In order to output the sheet P held in the first transportation route 71 from the output port 88, the flapper 77 arranged at the bifurcation into the first transportation route 71 and the second transportation route 81 is firstly set in the tilted position toward the first transportation route side opening 79 (position shown with the broken lines in FIG. 5). By this setting, the first transportation route side opening 79 is closed, while the second transportation route side opening 84 is opened, at the bifurcation.

In this case, in order to avoid interruption of the movement of the flapper 77 caused by the back end T side of the sheet P held in the first transportation route 71, the back end T of the sheet P is set to be located on the downstream side of the bifurcation in the sheet transportation direction in the case where the sheet P on which the various kinds of information has been formed as an image is stopped in the first transportation route 71. Specifically, the sheet transportation mechanism 1B stops the sheet P so that the back end T of the sheet P is located on the downstream side of an intersection of the movable region of the flapper 77 and the first transportation route 71 (for example, a region D in FIG. 5) in the sheet transportation direction.

Thereby, the sheet transportation mechanism 1B causes the sheet P held in the first transportation route 71 to be received from the first transportation route 71 into the second transportation route 81 without additional sheet transportation operation for positioning the back end T of the sheet P on the downstream side of the bifurcation in the sheet transportation direction. In addition, forming a curve (curl) of the sheet P is suppressed by avoiding holding the sheet P in a curved region in the first transportation route 71, for example.

Note that, also in the image forming apparatus 1 according to the second exemplary embodiment, the transportation route length L1 from the position of the nip portion N of the fixing device 40 in the image forming mechanism 1A to the position of the output port 78 as the terminal end of the first transportation route 71, along the first transportation route 71, is set longer than the maximum length in the transportation direction of the sheet Pmax usable in the image forming mechanism 1A, similarly to the case of the above-mentioned first exemplary embodiment.

<Description of Operation for Outputting Sheet from Output Port Arranged on Back Side>

A description will be continued of the operation for outputting the sheet P held in the first transportation route 71 from the output port 88 arranged on the back side of the image forming apparatus 1.

Figure 6:
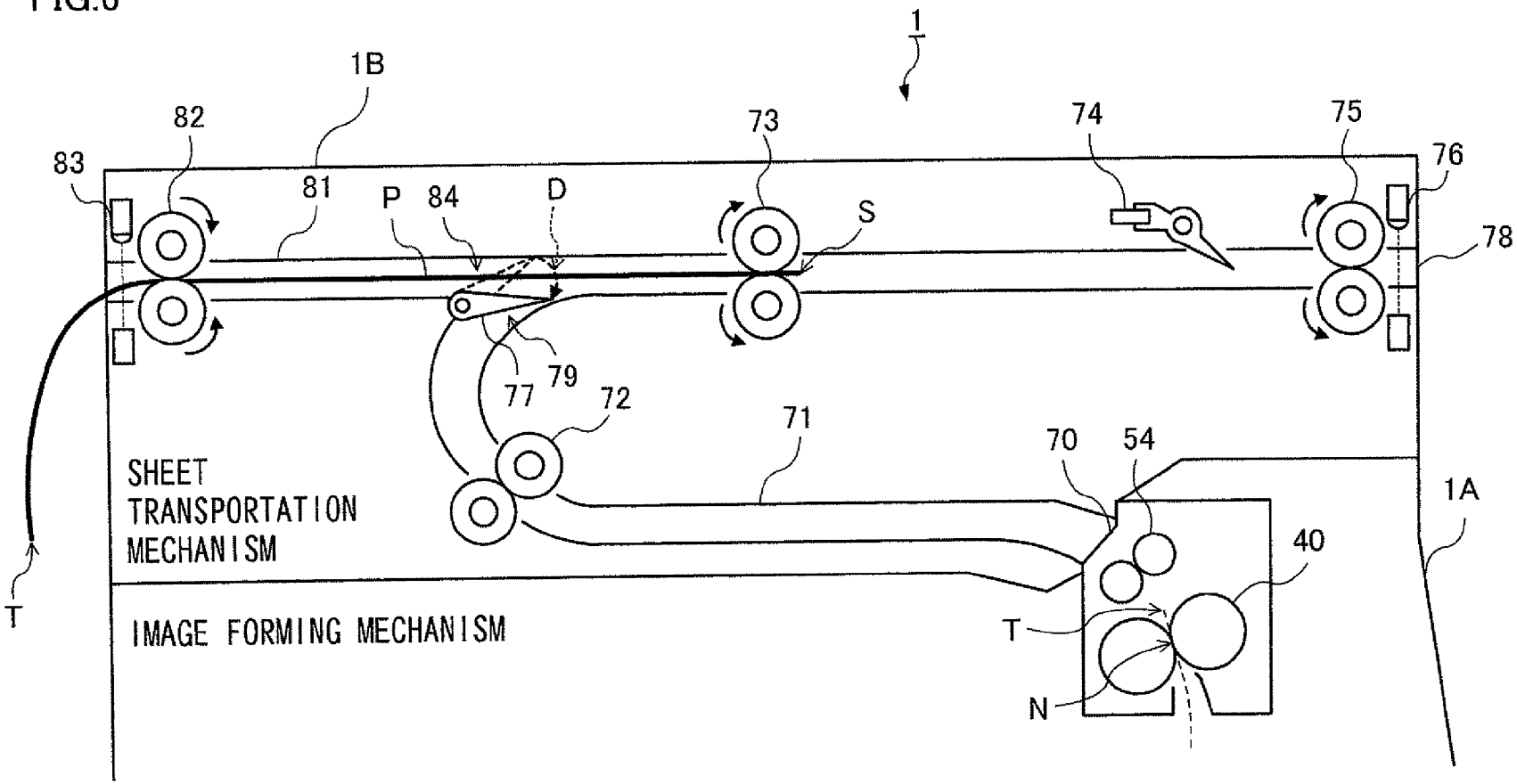
FIG. 6 is a view for explaining the operation for outputting the sheet held in the first transportation route from the output port.

FIG. 6 is a view for explaining the operation for outputting the sheet P held in the first transportation route 71 from the output port 88. As shown in FIG. 6, when a predetermined time passes after the transportation rolls 72 and 73 and the discharge roll 75 are stopped, the flapper 77 arranged at the bifurcation into the first transportation route 71 and the second transportation route 81 is set in a tilted position toward the first transportation route side opening 79 (position shown with solid lines in FIG. 6). Then, the transportation roll 73 and the discharge roll 75, which are provided in the first transportation route 71, rotate to transport the sheet P held in the first transportation route 71 into the second transportation route 81. By this operation, the sheet P held in the first transportation route 71 is received into the second transportation route 81 from the second transportation route side opening 84.

After that, the sheet P is outputted from the output port 88 by the discharge roll 82 provided in the second transportation route 81. The sheet output detection part 83 detects that the sheet P is outputted from the output port 88.

As mentioned above, it is assumed that the image forming apparatus 1 according to the second exemplary embodiment is installed, for example, at an aisle or along a wall in a public facility such as a station, an airport or the like where a large number of unspecified users access. Thus, in a case where a sheet P is not pulled out from the sheet transportation mechanism 1B by a user, the sheet P for the previous operation is to be outputted to the outside by the next sheet transportation operation for the sheet P on which the various kinds of information has been formed as an image by the next user. In this case, since the outputted sheet P is unnecessary for the next user, it is highly possible that the sheet P may be left as garbage.

To avoid this, in the image forming apparatus 1 according to the second exemplary embodiment, the sheet P that is left in the first transportation route 71 and is not pulled out from the sheet transportation mechanism 1B by a user is retrieved from the output port 88. For example, the image forming apparatus 1 is installed in the following manner. The back side of the image forming apparatus 1, where the output port 88 is arranged, is connected to the inside of an administration office that manages the image forming apparatus 1. Further, the front side of the image forming apparatus 1, where the output port 78 is arranged, faces a public space where unspecified users access. By installing the image forming apparatus 1 in such a manner, the sheet P retrieved through the output port 88 is handled in the administration office. Thus, the occurrence in which the sheet P providing usable information for a user is left as garbage is reduced.

Moreover, a retrieval box for retrieving the sheets P may be arranged below the output port 88.

<Description of Contents of Sheet Transportation Control by Main Controller>

Next, a description will be given of the contents of the sheet transportation control for retrieving the sheet P left in the first transportation route 71, which is performed by the main controller 60.

Figure 7:
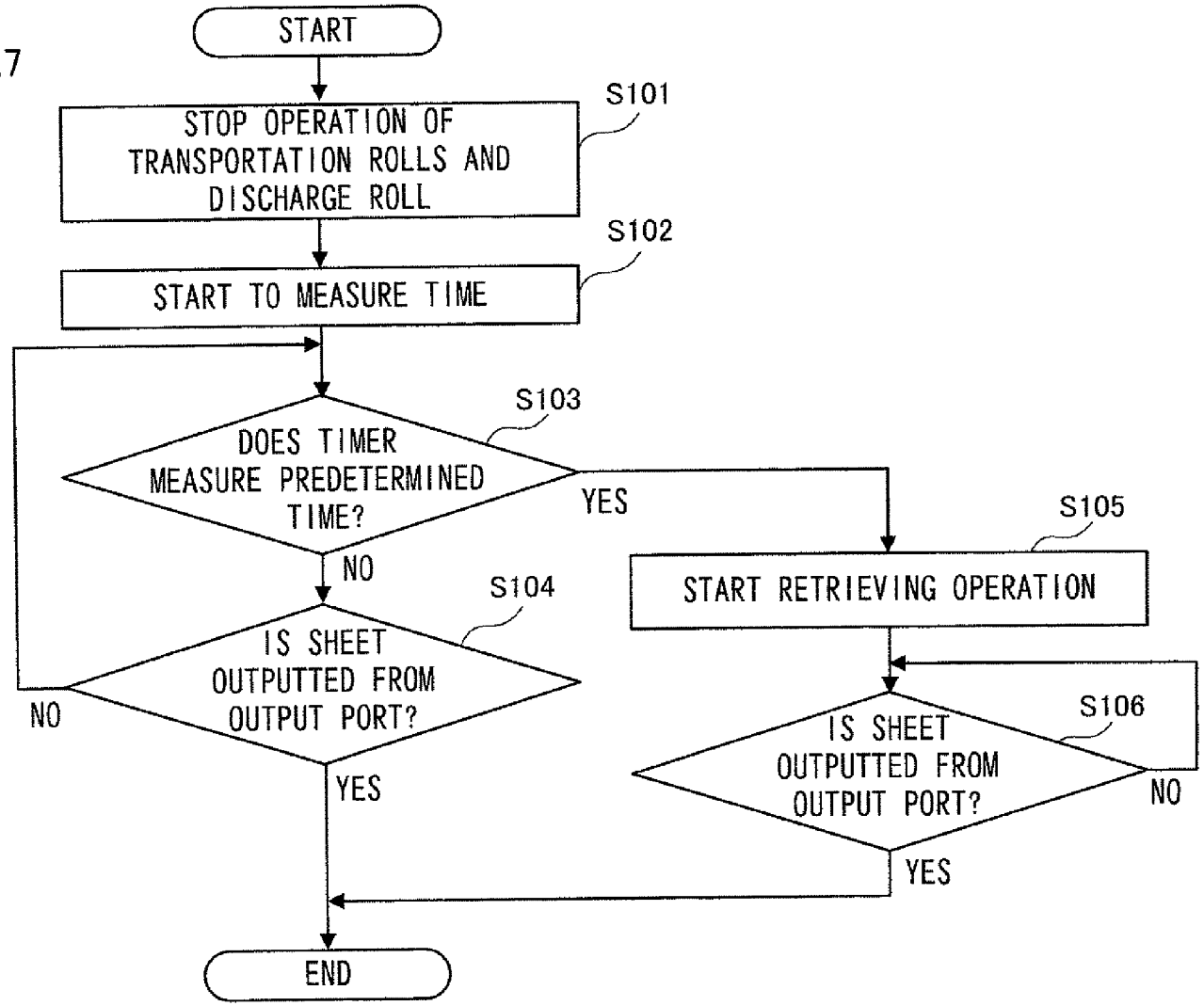
FIG. 7 is a flowchart showing an example of the contents of the sheet transportation control for retrieving the sheet, performed by the main controller.

FIG. 7 is a flowchart showing an example of the contents of the sheet transportation control for retrieving the sheet P, performed by the main controller 60.

As shown in FIG. 7, the main controller 60 transports the sheet P to the position so that the top end S of the sheet P is outputted from the output port 78 by the predetermined length, and stops the operation of the transportation rolls 72 and 73 and the discharge roll 75 (Step 101). At this time, the main controller 60 causes a timer to start to measure time (Step 102). Then, if the sheet output detection part 76 detects that the sheet P is outputted from the output port 78 before the timer measures the predetermined time (No in Step 103 and Yes in Step 104), the retrieving operation for receiving the sheet P held in the first transportation route 71 into the second transportation route 81 is not performed, and the sheet transportation control is finished.

Note that, the main controller 60 waits for the sheet output detection part 76 to detect that the sheet P is outputted, until the timer has measured the predetermined time (No in Step 103 and No in Step 104).

On the other hand, if the sheet output detection part 76 does not detect that the sheet P is outputted from the output port 78 even after the timer has measured the predetermined time (Yes in Step 103), the main controller 60 recognizes that the user does not perform the pull out operation, and starts the retrieving operation for receiving the sheet P held in the first transportation route 71 into the second transportation route 81 (Step 105).

Then, the main controller 60 waits for the sheet output detection part 83 to detect that the sheet P is outputted from the output port 88 (No in Step 106). If the sheet output detection part 83 detects that the sheet P is outputted from the output port 88 (Yes in Step 106), the sheet transportation control for retrieving the sheet P is finished.

In the second exemplary embodiment, after the predetermined time has passed since the transportation rolls 72 and 73 and the discharge roll 75 are stopped, the sheet transportation operation for retrieving, from the output port 88, the sheet P not pulled out from the sheet transportation mechanism 1B is set to be started. Instead of this configuration, for example, the following configuration may be employed. Specifically, the main controller 60 recognizes that the user does not perform the pull out operation before the next user makes a new image formation request for various kinds of information through the operation display panel 62 after the transportation rolls 72 and 73 and the discharge roll 75 are stopped, and the sheet transportation operation for retrieving, from the output port 88, the sheet P not pulled out from the sheet transportation mechanism 1B is started.

<Description of Internal Configuration of Main Controller>

Figure 8:
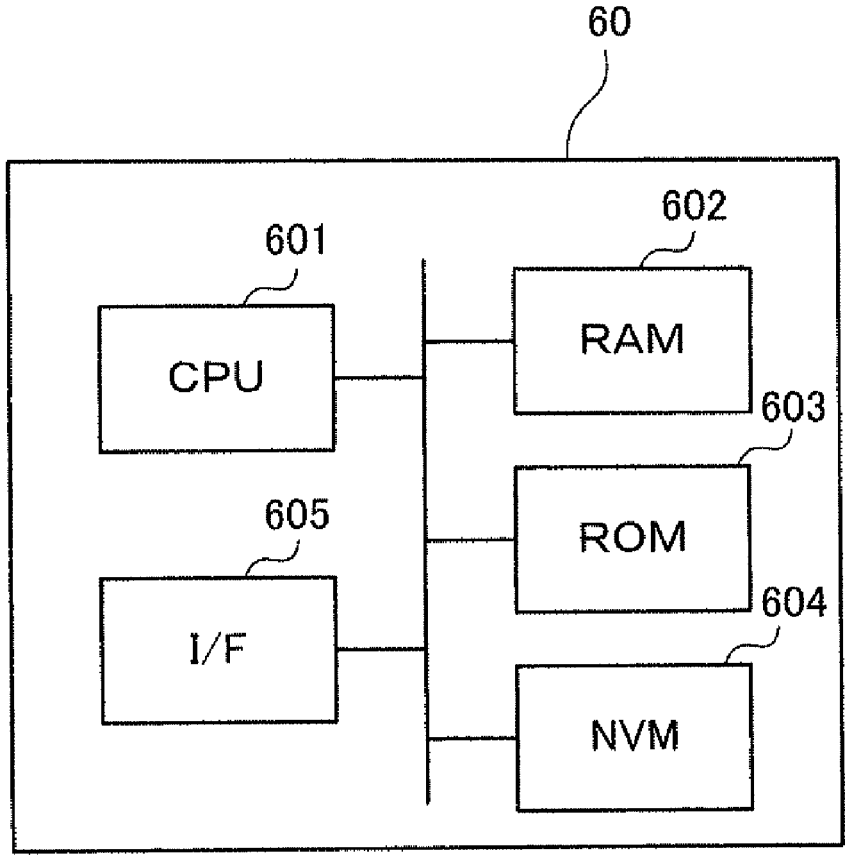
FIG. 8 is a block diagram showing an internal configuration of the main controller.

Next, FIG. 8 is a block diagram showing an internal configuration of the main controller 60. As shown in FIG. 8, the main controller 60 includes a CPU 601, a RAM 602, a ROM 603, a non-volatile memory (NVM) 604, and an interface (I/F) 605. The CPU 601 performs a digital arithmetic processing in accordance with a predetermined processing program for the execution of the sheet transportation control in the sheet transportation mechanism 1B, including the sheet transportation control for retrieving the sheet P left in the first transportation route 71. The RAM 602 is used as a working memory of the CPU 601. The ROM 603 stores various setting values to be used in the processing by the CPU 601. The NVM 604 is a battery-backed rewritable flush memory or the like capable of storing data even when power supply is lost. The I/F 605 controls input and output of a signal to and from respective functional units such as the motor driver (not shown in the figure) controlling the drive motor arranged in the sheet transportation mechanism 1B, the operation display panel 62, the communication part 63, the external storage 64 and the like arranged in the image forming mechanism 1A.

The CPU 601 loads the processing program from the external storage 64 into the main memory (RAM 602), and then implements respective functions in the main controller 60.

Note that, another mode of providing the processing program is to provide the processing program stored in advance in the ROM 603 and then load the processing program into the RAM 602. Still another way, if the rewritable ROM 603 such as an electrically erasable and programmable ROM (EEPROM) is included, is to install only the program into the ROM 603 after setting of the CPU 601, and then load the program into the RAM 602. Still another way is to transmit the program to the main controller 60 via a network such as the Internet, install the program into the ROM 603 of the main controller 60, and then load the program into the RAM 602. Even still another way is to load the program from an external recording medium such as a DVD-ROM or a flash memory into the RAM 602.

Third Exemplary Embodiment

In the first and second exemplary embodiments, a description has been given of the image forming apparatus 1 having a configuration in which the user pulls out the sheet P from the output port 78 arranged on the front side of the image forming apparatus 1 (the side located on the right side of FIG. 1). In the third exemplary embodiment, a description will be given of the image forming apparatus 1 having a configuration in which a user pulls out a sheet P from not only the output port 78 arranged on the front side of the image forming apparatus 1 but also the output port 88 arranged on the back side of the image forming apparatus 1, which is arranged on the opposite side of the front side. Note that, the same components as those in the first and second exemplary embodiments are denoted by the same reference numerals, and the detailed description thereof will be omitted.

<Description of Configuration of Sheet Transportation Mechanism>

Figure 9:
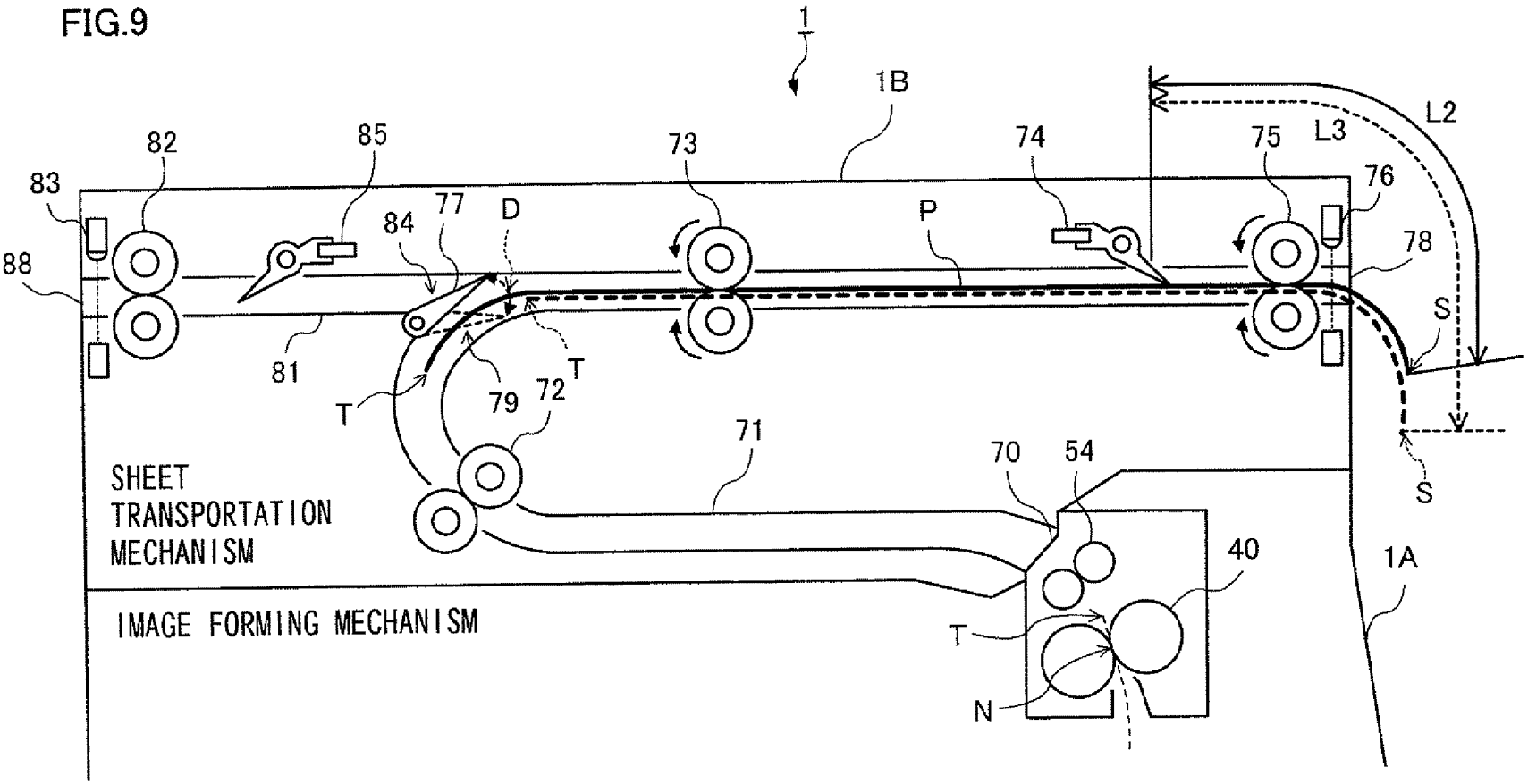
FIG. 9 is a view showing the configuration of the sheet transportation mechanism arranged in the image forming apparatus in the third exemplary embodiment.

FIG. 9 is a view showing the configuration of the sheet transportation mechanism 1B arranged in the image forming apparatus 1 in the third exemplary embodiment. As shown in FIG. 9, the sheet transportation mechanism 1B according to the third exemplary embodiment includes a second sheet passage detection part 85, in addition to the above-mentioned configuration in the second exemplary embodiment. The second sheet passage detection part 85, serving as an example of a detection unit (second detection unit), detects the passage of a sheet P in the second transportation route 81.

In the sheet transportation mechanism 1B, the output port for pulling out the sheet P is set at any one of the output port 78 and the output port 88 in accordance with a user's choice as to whether the sheet P is provided from the output port 78 arranged on the front side of the image forming apparatus 1 (side located on the right side in FIG. 9) or from the output port 88 arranged on the back side of the image forming apparatus 1 (side located on the left side in FIG. 9), or an automatic setting by the main controller 60. The sheet P on which the various kinds of information has been formed as an image in the image forming mechanism 1A is transported to a position so as to be outputted, by the predetermined length, from the any one of the output ports 78 and 88 that has been set, similarly to the cases of the first and the second exemplary embodiments. Then, the user pulls out the sheet P outputted from any one of the output ports 78 and 88, and thereby the entire sheet P is outputted to the outside of the apparatus.

As a configuration in which the main controller 60 automatically set any one of the output ports 78 and 88, the following configuration may be employed, as an example. For example, in addition to the operation display panel 62 (see FIG. 1) arranged on the front side of the image forming apparatus 1, another operation display panel 62 is arranged on the back side thereof where the output port 88 is arranged. With this configuration, the main controller 60 determines which one of the operation display panels 62 arranged on the front and back sides thereof receives an operation input by a user. By this determination, the main controller 60 sets the output port on the side where the operation display panel 62 having received the operation input by the user is arranged, as the output port for outputting the sheet P.

Note that, the flapper 77, the discharge roll 82, the sheet output detection part 83 and the second sheet passage detection part 85, which are arranged in the second transportation route 81, and the transportation roll 73 and the discharge roll 75, which are arranged in the first transportation route 71, forms a second recording medium transportation unit.

<Description of Contents of Sheet Transportation Control by Main Controller>

Next, a description will be given of contents of the sheet transportation control in the sheet transportation mechanism 1B according to the third exemplary embodiment, performed by the main controller 60.

FIGS. 10-1, 10-2 and 10-3 are flowcharts showing an example of the contents of the sheet transportation control for the sheet transportation mechanism 1B, performed by the main controller 60.

Figures 1, 10:
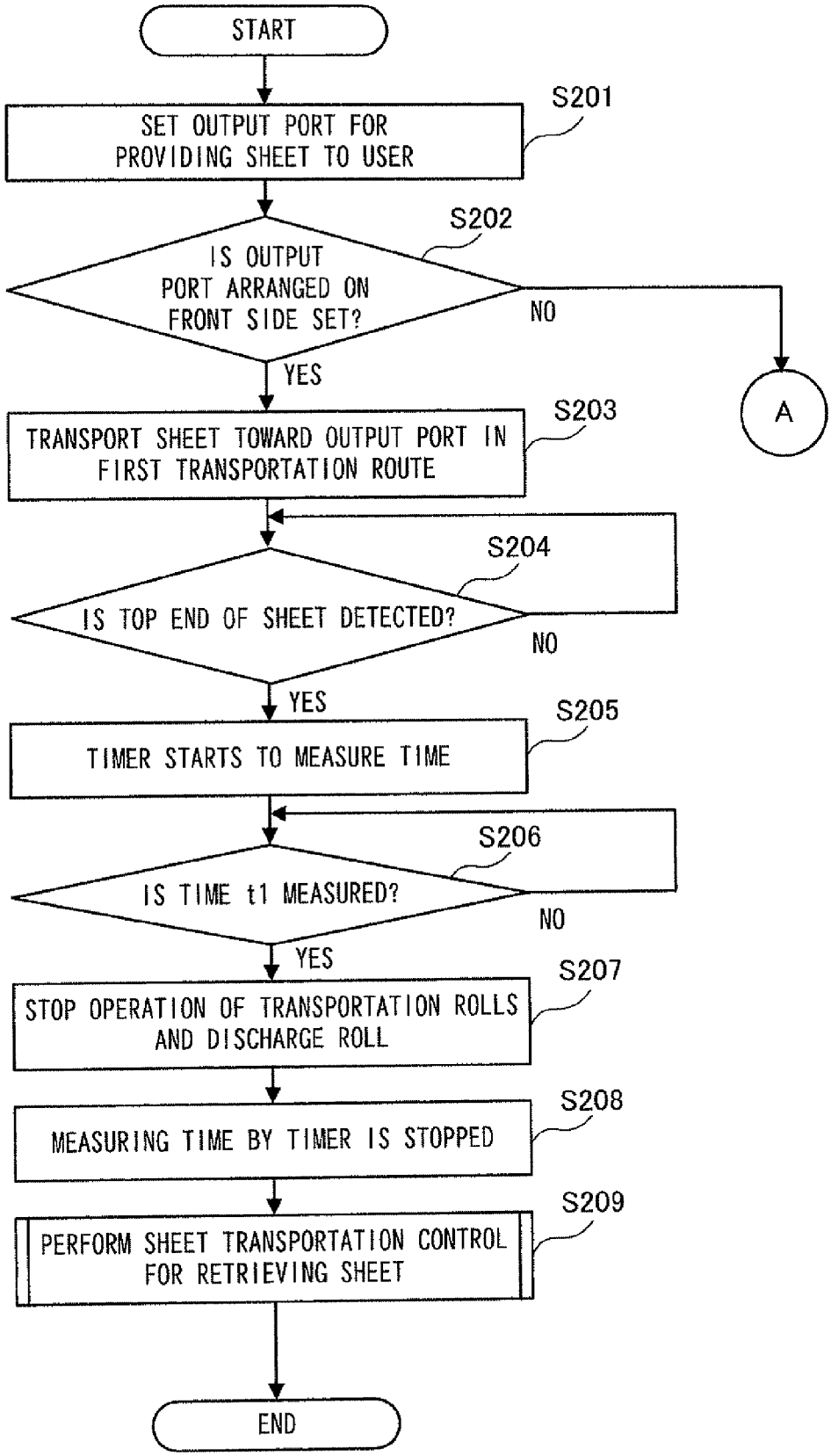
Figures 2, 10:
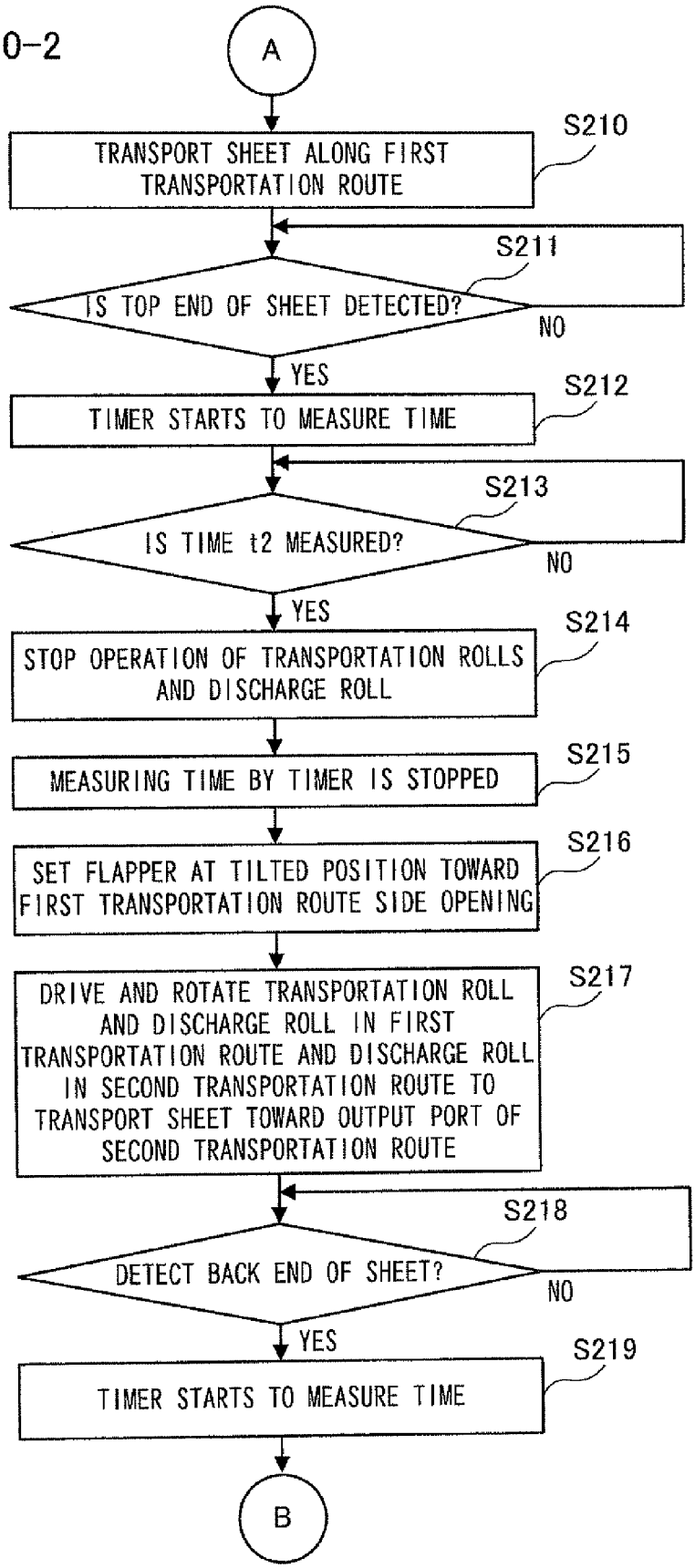

First, as shown in FIG. 10-1, the main controller 60 sets any one of the output ports 78 and 88 arranged on the front and back sides of the image forming apparatus 1, respectively, as the output port for providing the sheet P from the image forming mechanism 1A to a user in response to an operation input by the user, for example (Step 201). If the main controller 60 sets the output port 78 arranged on the front side as the output port for providing the sheet P (Yes in Step 202), the main controller 60 operates the transportation rolls 72 and 73 and the discharge roll 75 provided in the first transportation route 71 to transport the sheet P toward the output port 78 in the first transportation route 71 (Step 203).

Upon start of the transportation of the sheet P toward the output port 78, the main controller 60 waits for the first sheet passage detection part 74, serving as an example of a first detection unit, to detect the top end S of the sheet P (No in Step 204). If the first sheet passage detection part 74 detects the top end S of the sheet P (Yes in Step 204), the main controller 60 acquires detection information from the first sheet passage detection part 74, and thereby causes the timer (not shown in the figure) to start to measure time (Step 205). Then, at a time point when time t1, which is calculated from the sheet transportation speed in the sheet transportation mechanism 1B and the transportation route length L2 (solid line in FIG. 9) for the sheet P from the position of the first sheet passage detection part 74 to the position of the top end S of the sheet P outputted by the predetermined length from the output port 78, is measured by the timer (Yes in Step 206), the operation of the transportation rolls 72 and 73 and the discharge roll 75 is stopped (Step 207). Further, measuring the time by the timer is also stopped (Step 208). Note that, the position of the sheet P at the time point when the main controller 60 stops the operation of the transportation rolls 72 and 73 and the discharge roll 75 has been already described in the above FIG. 9.

However, until the timer has measured the time t1 (No in Step 206), the operation of the transportation rolls 72 and 73 and the discharge roll 75 is continued, and measuring time by the timer is also continued.

After stopping measuring time by the timer, the main controller 60 performs the sheet transportation control for retrieving the sheet P, which has been already described in FIG. 7 according to the second exemplary embodiment (Step 209). After the sheet transportation control for retrieving the sheet P is finished, all of the sheet transportation control is finished.

The flow proceeds to FIG. 10-2. If the main controller 60 sets the output port 88 arranged on the back side as the output port for providing the sheet P (No in Step 202), the main controller 60 operates the transportation rolls 72 and 73 and the discharge roll 75 to transport the sheet P along the first transportation route 71 once (Step 210).

Upon the start of the transportation of the sheet P along the first transportation route 71, the main controller 60 waits for the first sheet passage detection part 74 to detect the top end S of the sheet P (No in Step 211). If the first sheet passage detection part 74 detects the top end S of the sheet P (Yes in Step 211), the main controller 60 acquires the detection information from the first sheet passage detection part 74, and thereby causes the timer (not shown in the figure) to start to measure time (Step 212). Then, at a time point when time t2, which is calculated from the sheet transportation speed in the sheet transportation mechanism 1B and the transportation route length L3 (broken line in FIG. 9) for the sheet P from the position of the first sheet passage detection part 74 to the position of the top end S of the sheet P outputted by the predetermined length from the output port 78, is measured by the timer (Yes in Step 213), the operation of the transportation rolls 72 and 73 and the discharge roll 75 is stopped (Step 214). Further, measuring the time by the timer is also stopped (Step 215).

Note that, the transportation route length L3 here is set so that the back end T of the sheet P is located on the downstream side of a position (for example, the region D in FIG. 9) where the movable region of the flapper 77 and the first transportation route 71 intersects with each other in the sheet transportation direction when the top end S of the sheet P arrives at the position set in accordance with the transportation route length L3.

After stopping the operation of the transportation rolls 72 and 73 and the discharge roll 75, the main controller 60 sets the flapper 77 at a tilted position toward the first transportation route side opening 79 (position shown with a broken line in FIG. 9) (Step 216). Then the main controller 60 drives and rotates the transportation roll 73 and the discharge roll 75 provided in the first transportation route 71, and the discharge roll 82 provided in the second transportation route 81, to transport the sheet P held in the first transportation route 71 toward the output port 88 as a terminal end of the second transportation route 81 (Step 217). Thereby, the sheet P held in the first transportation route 71 is received into the second transportation route 81 from the second transportation route side opening 84.

Upon receiving the sheet P into the second transportation route 81, the main controller 60 waits the second sheet passage detection part 85, serving as a second detection unit, to detect the back end T of the sheet P (No in Step 218). If the second sheet passage detection part 85 detects the back end T of the sheet P (Yes in Step 218), the main controller 60 acquires detection information from the second sheet passage detection part 85, and causes the timer (not shown in the figure) to start to measure time (Step 219).

Figures 3, 10:
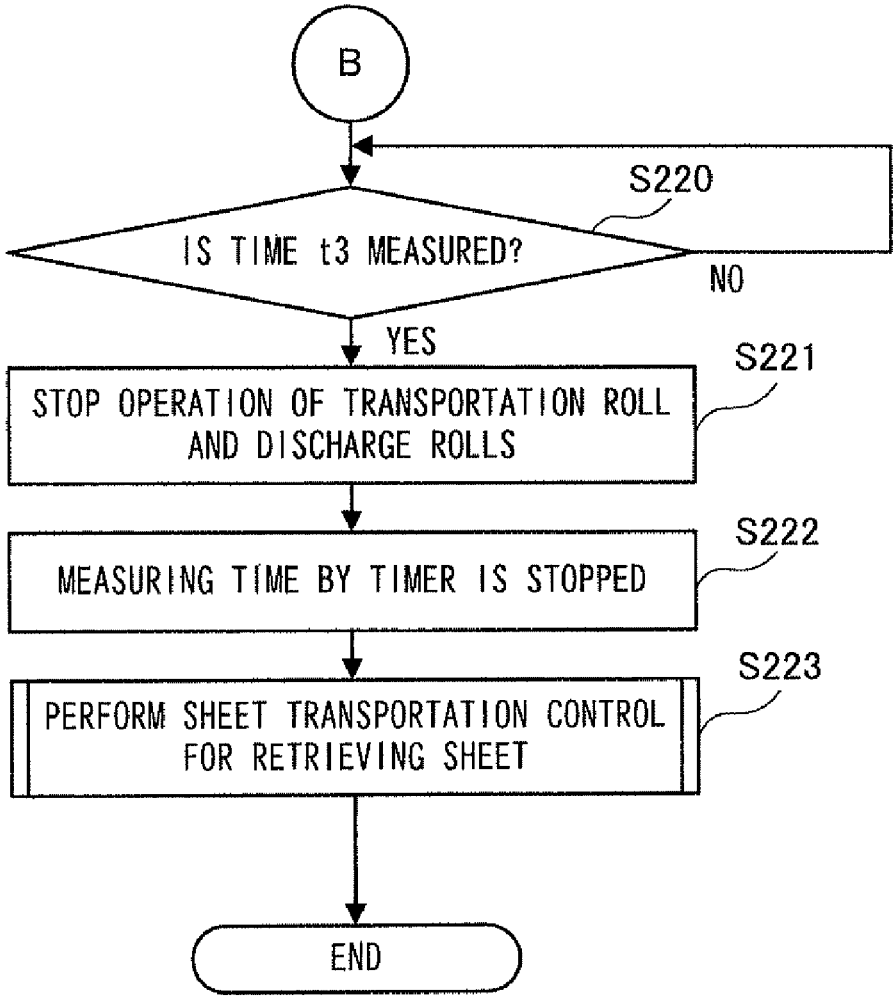
Figure 11:
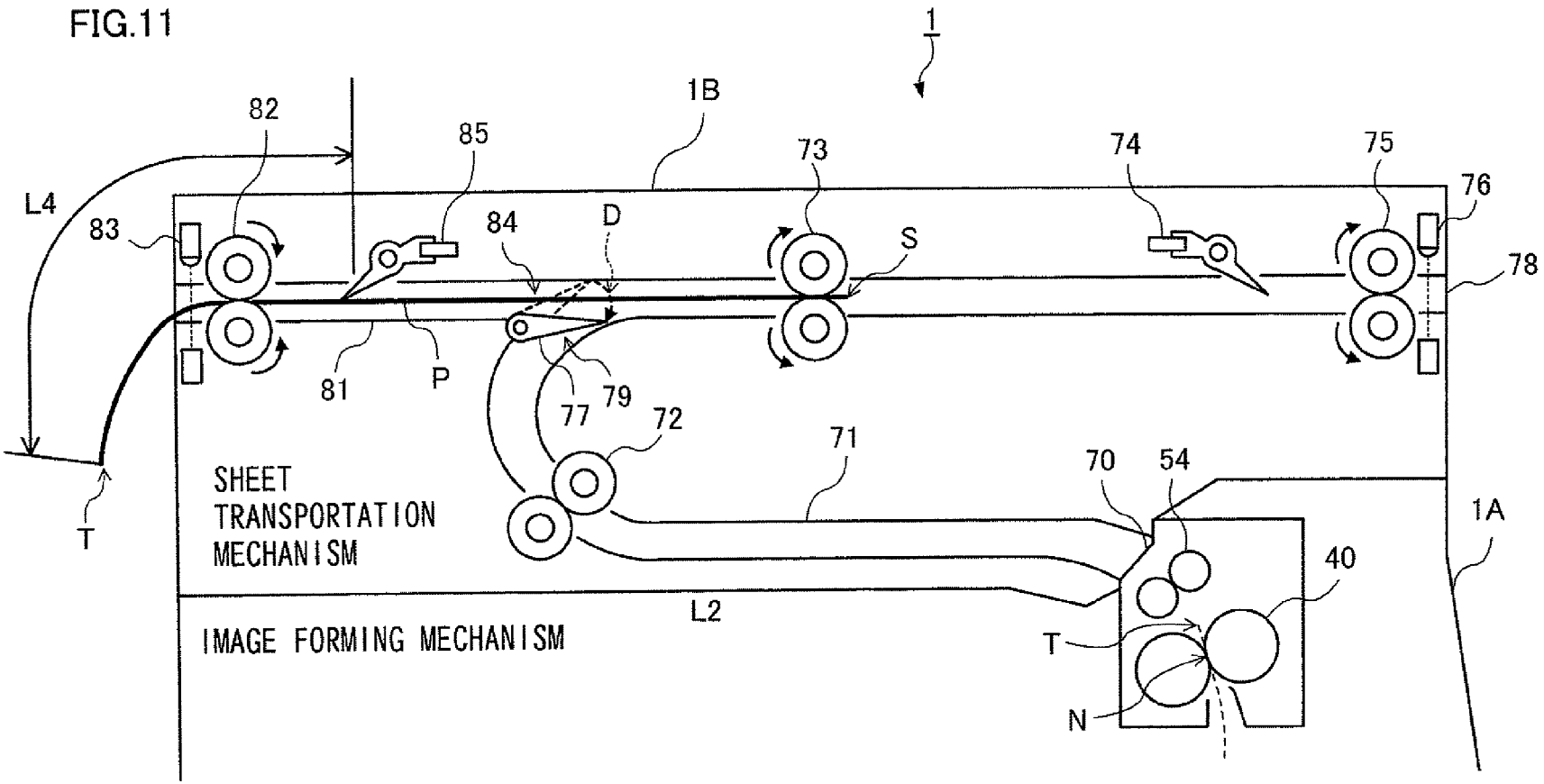
FIG. 11 is a view showing the position of the sheet at the time point when the main controller stops the operation of the transportation roll and the discharge rolls.

Subsequently, the flow proceeds to FIG. 10-3. At a time point when time t3, which is calculated from the sheet transportation speed in the sheet transportation mechanism 1B and the transportation route length L4 (see FIG. 11: a view showing the position of the sheet P at the time point t3 when the main controller 60 stops the operation of the transportation roll 73 and the discharge rolls 75 and 82) for the sheet P from the position of the second sheet passage detection part 85 to the position of the back end T of the sheet P outputted by the predetermined length from the output port 88, is measured by the timer (Yes in Step 220), the operation of the transportation roll 73 and the discharge rolls 75 and 82 is stopped (Step 221). Further, measuring the time by the timer is also stopped (Step 222). Note that, the position of the sheet P at the time point when the main controller 60 stops the operation of the transportation rolls 73 and the discharge rolls 75 and 82 is shown in FIG. 11.

However, until the timer has measured the time t3 (No in Step 220), the operation of the transportation roll 73 and the discharge rolls 75 and 82 is continued, and measuring time by the timer is also continued.

After stopping the operation of the transportation roll 73 and the discharge rolls 75 and 82, the main controller 60 performs the sheet transportation control for retrieving the sheet P, which has been already described in FIG. 7 according to the second exemplary embodiment (Step 223). Note that, in the sheet transportation control for retrieving the sheet P here, the sheet P is retrieved from the output port 78 arranged on the front side of the image forming apparatus 1.

After the sheet transportation control for retrieving the sheet P, all of the sheet transportation control is finished.

As mentioned above, in the image forming apparatus 1 according to the third exemplary embodiment, any one of the output ports 78 and 88 arranged on the front and back sides of the image forming apparatus 1, respectively, is used as the output port from which a user receives the sheet P on which the various kinds of information has been formed as an image. Thereby, a degree of the freedom for selection of installation places for installing the image forming apparatus 1 is increased in public facilities and the like such as stations, airports and the like where a large number of unspecified users access.

Note that, also in the image forming apparatus 1 according to the third exemplary embodiment, the transportation route length L1 along the first transportation route 71, from the position of the nip portion N of the fixing device 40 of the image forming mechanism 1A to the position of the output port 78 as the terminal end of the first transportation route 71, is configured so as to be longer than the maximum length in the transportation direction of the sheet Pmax usable in the image forming mechanism 1A, similarly to the case in the above-mentioned first exemplary embodiment.

As described above, in the image forming apparatus 1 according to the third exemplary embodiment, the transportation route length L1 along the first transportation route 71, from the position of the nip portion N of the fixing device 40 serving as an image formation functional unit arranged on the most downstream portion of the image forming unit (image forming part 20) in the transportation direction of a sheet P to the position of the output port 78 as the terminal end of the first transportation route 71, is set longer than the maximum length in the transportation direction of the sheet Pmax usable in the image forming mechanism 1A. Thereby, at the time point when the top end S of the sheet Pmax having the maximum length in the transportation direction and usable in the image forming mechanism 1A arrives at the output port 78, the fixing processing for the entire sheet P has been completed in the fixing device 40.

Thus, before the sheet P arrives at an assumed position where the user starts the pull out operation for the sheet P, such as a time point when the top end S of the sheet P is outputted from the output port 78, for example, even if the user forcibly performs the pull out operation immediately, occurrences of troubles such as the damage of the belt members and the like forming the nip portion N of the fixing device 40, strain on the sheet P and the like are reduced.

In the image forming apparatus 1 according to the third exemplary embodiment, the sheet P remained in the first transportation route 71 and not being pulled out by the user from the sheet transportation mechanism 18 may be configured to be retrieved from the output port 88. Thereby, the occurrence that the sheet P for providing usable information to a user is left as garbage is reduced.

In addition, in the image forming apparatus 1 according to the third exemplary embodiment, multiple output ports from which the user receives the sheet P on which the various kinds of information has been formed as an image may be provided, and one of them may be selectively used. Thereby, the degree of the freedom for selection of installation places for installing the image forming apparatus 1 is increased in public facilities and the like such as stations, airports and the like where a large number of unspecified users access.

Note that, in these exemplary embodiments, the description has been given of the image forming apparatus 1 including the image forming mechanism 1A that transports the sheet P from the lower side to the upper side in the approximately vertical direction (direction shown with an arrow in FIG. 1). However, the present invention is applicable to, for example, an image forming apparatus including an image forming mechanism that transports the sheet P in an approximately horizontal direction, and an image forming apparatus including an image forming mechanism that transports the sheet P from the lower side to the upper side in an oblique direction.

Moreover, in these exemplary embodiments, the description has been given of the electrophotographic image forming apparatus 1. However, an inkjet type image forming apparatus may be alternatively used. In this case, the transportation route length along the transportation route, from a position of an ink head of the inkjet type image forming apparatus (ink jet part that jets ink to a sheet to form an ink image) to a position of a sheet output port, is configured to be longer than the maximum length in the transportation direction of the sheet usable in the image forming apparatus. In other words, regardless of the image forming method, it is only necessary that the transportation route length from the image forming functional part arranged at the most downstream portion of the image forming unit in the sheet transportation direction to the sheet output port is longer than the maximum length in the sheet transportation direction of the sheet usable in the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a first transportation route that forms a transportation route for the recording medium received from the image forming unit, the transportation route extending to an outside of the image forming apparatus, and that has a transportation route length for the recording medium longer than a maximum length in a transportation direction of the recording medium usable in the image forming unit, the transportation route length being from a position of an image formation functional unit arranged at a most downstream portion of the image forming unit in the transportation direction of the recording medium to a position where the recording medium is outputted to the outside of the image forming apparatus;

a recording medium transportation unit;

a detector that detects when a part of the recording medium is output from the first transportation route; and a controller configured to control the recording medium transportation unit to stop transportation of the recording medium after the detector detects that a part of the recording medium is output from the first transportation route, so that a remaining part of the recording medium is held in the first transportation route, the recording medium being output to the outside of the image forming apparatus in accordance with a pull out operation by a user for the recording medium after transportation has been stopped, wherein the recording medium transportation unit interrupts the transportation of the recording medium before the part of the recording medium is outputted from the first transportation route, and restarts the transportation of the recording medium after interrupting the transportation of the recording medium, and then transports the recording medium until the part of the recording medium is outputted from the first transportation route.

2. The image forming apparatus according to claim 1, further comprising a second transportation route that is connected to the first transportation route, and that outputs the recording medium to the outside of the image forming apparatus from a position different from a position in the first transportation route where the recording medium held in the first transportation route is outputted to the outside of the image forming apparatus, wherein the recording medium transportation unit stops the transportation of the recording medium in the first transportation route at a position where a back end of the recording medium arrives at a position on a downstream side of a bifurcation into the first transportation route and the second transportation route in the transportation direction.

3. The image forming apparatus according to claim 2, the controller controls the recording medium transportation unit so that the recording medium held in the first transportation route is transported toward the second transportation route in a case where the pull out operation is not performed by the user even after time set in advance has passed since the stop of the transportation of the recording medium in the first transportation route.

4. The image forming apparatus according to claim 2, the controller controls the recording medium transportation unit so that the recording medium held in the first transportation route is transported toward the second transportation route in a case where the pull out operation is not performed by the user before a new image formation instruction to the image forming unit is received after the stop of the transportation of the recording medium in the first transportation route.

5. The image forming apparatus according to claim 1, further comprising:

a second transportation route that is connected to the first transportation route, and that outputs the recording medium to the outside of the image forming apparatus from a different position from a position in the first transportation route where the recording medium held in the first transportation route is outputted to the outside of the image forming apparatus;

a second recording medium transportation unit that, upon output of a part of the recording medium from the second transportation route through transportation of the recording medium along the second transportation route, stops the transportation of the recording medium in a state where a remaining part of the recording medium is held in the second transportation route while outputting the recording medium in accordance with the pull out operation by the user for the recording medium whose transportation has been stopped; and the controller that selects any one of the first transportation route and the second transportation route, and that controls the recording medium transportation unit and the second recording medium transportation unit so that the recording medium received from the image forming unit is outputted to the outside of the image forming apparatus from the selected one of the first transportation route and the second transportation route.

6. The image forming apparatus according to claim 1, wherein the image forming unit has a toner image forming part that forms a toner image on a recording medium, and a fixing part that performs fixing processing for the recording medium on which the toner image has been formed by the toner image forming part, and the first transportation route forms the transportation route for the recording medium received from the image forming unit, the transportation route extending to the outside of the image forming apparatus, and has a transportation route length for the recording medium longer than the maximum length in the transportation direction of the recording medium usable in the image forming unit, the transportation route length being from a position where the fixing processing is performed by the fixing part to the position where the recording medium is outputted to the outside of the image forming apparatus.

7. The image forming apparatus according to claim 1, wherein the image forming unit has an ink jet part that jets ink to a recording medium to form an ink image, and the first transportation route forms the transportation route for the recording medium received from the image forming unit, the transportation route extending to the outside of the image forming apparatus, and has a transportation route length for the recording medium longer than the maximum length in the transportation direction of the recording medium usable in the image forming unit, the transportation route length being from a position of the ink jet part to the position where the recording medium is outputted to the outside of the image forming apparatus.

8. A recording medium transportation apparatus comprising:

a first transportation route that forms a transportation route for a recording medium received from an image forming unit forming an image on the recording medium, the transportation route extending to an outside of the recording medium transportation apparatus, and that has a transportation route length for the recording medium longer than a maximum length in a transportation direction of the recording medium usable in the image forming unit, the transportation route length being from a position of an image formation functional unit arranged at a most downstream portion of the image forming unit in the transportation direction of the recording medium to a position where the recording medium is outputted to the outside of the recording medium transportation apparatus; and a recording medium transportation unit;

a detector that detects when a part of the recording medium is output from the first transportation route; and a controller configured to control the recording medium transportation unit to stop transportation of the recording medium after the detector detects that a part of the recording medium is output from the first transportation route, so that a remaining part of the recording medium is held in the first transportation route, the recording medium being output to the outside of the image forming apparatus in accordance with a pull out operation by a user for the recording medium after transportation has been stopped, wherein the recording medium transportation unit interrupts the transportation of the recording medium before the part of the recording medium is outputted from the first transportation route, and restarts the transportation of the recording medium after interrupting the transportation of the recording medium, and then transports the recording medium until the part of the recording medium is outputted from the first transportation route.

9. The recording medium transportation apparatus according to claim 8, further comprising a second transportation route that is connected to the first transportation route, and that outputs the recording medium to the outside of the recording medium transportation apparatus from a different position from a position in the first transportation route where the recording medium held in the first transportation route is outputted to the outside of the recording medium transportation apparatus, wherein the recording medium transportation unit stops the transportation of the recording medium in the first transportation route at a position where a back end of the recording medium arrives at a position on a downstream side of a bifurcation into the first transportation route and the second transportation route in the transportation direction.

10. The recording medium transportation apparatus according to claim 8, further comprising:

a second transportation route that is connected to the first transportation route, and that outputs the recording medium to the outside of the recording medium transportation apparatus from a position different from a position in the first transportation route where the recording medium held in the first transportation route is outputted to the outside of the recording medium transportation apparatus; and a second recording medium transportation unit that, upon output of a part of the recording medium from the second transportation route through transportation of the recording medium along the second transportation route, stops the transportation of the recording medium in a state where a remaining part of the recording medium is held in the second transportation route while outputting the recording medium in accordance with the pull out operation by the user for the recording medium whose transportation has been stopped.

11. The recording medium transportation apparatus according to claim 8, wherein the first transportation route forms the transportation route for the recording medium received from the image forming unit that has a toner image forming part forming a toner image on the recording medium and a fixing part performing fixing processing for the recording medium on which the toner image has been formed by the toner image forming part, the transportation route extending to the outside of the recording medium transportation apparatus, and has a transportation route length for the recording medium longer than the maximum length in the transportation direction of the recording medium usable in the image forming unit, the transportation route length being from a position where the fixing processing is performed on the recording medium by the fixing part to the position where the recording medium is outputted to the outside of the recording medium transportation apparatus.

* * * * *